US005422070A

United States Patent [19]

Nazmy et al.

[11] Patent Number: 5,422,070

[45] Date of Patent: Jun. 6, 1995

[54] OXIDATION-RESISTANT AND CORROSION-RESISTANT ALLOY BASED ON DOPED IRON ALUMINIDE, AND USE OF SAID ALLOY

[76] Inventors: Mohamed Y. Nazmy, Zelglistr. 30,, 5442 Fislisbach; Corrado Noseda, Wiesenstr. 9, 8953 Dietikon; Markus Staubli, Haushalde 9, 5605 Dottikon, all of Switzerland

[21] Appl. No.: 181,427

[22] Filed: Jan. 14, 1994

[30] Foreign Application Priority Data

Feb. 5, 1993 [DE] Germany ..... 43 03 316.4

[51] Int. Cl.[6] ..... C22C 38/06; C22C 38/26

[52] U.S. Cl. ..... 420/62; 420/79

[58] Field of Search ..... 420/79, 62, 63

[56] References Cited

U.S. PATENT DOCUMENTS

| | | | |
|---|---|---|---|
| 4,439,236 | 3/1984 | Ray . | |
| 4,576,653 | 3/1986 | Ray . | |
| 4,844,865 | 7/1989 | Shimada et al. | 420/79 |
| 4,961,903 | 10/1990 | McKamey et al. | 420/79 |
| 5,158,744 | 10/1992 | Nazmy | 420/79 |

FOREIGN PATENT DOCUMENTS

| | | |
|---|---|---|
| 0413029A1 | 2/1991 | European Pat. Off. . |
| 2364131 | 6/1974 | Germany . |
| 3011152 | 10/1980 | Germany . |

*Primary Examiner*—Deborah Yee

*Attorney, Agent, or Firm*—Burns, Doane, Swecker & Mathis

[57] ABSTRACT

The alloy is based on doped iron aluminide $Fe_3Al$. It contains the following alloying constituents in atomic percent:

| | |
|---|---|
| 24 | 28 aluminum, |
| 0.1 | 2 niobium, tantalum and/or tungsten, |
| 0.1 | 10 chromium, |
| 0.1 | 2 silicon, |
| 0.1 | 5 boron, |
| 0.01 | 2 titanium, |

the remainder being iron. The alloy is notable for a high oxidation resistance and corrosion resistance even at temperatures above 700° C. and is preferably used in components which are exposed to oxidizing and corrosive actions at high temperatures and low mechanical stress.

7 Claims, 1 Drawing Sheet

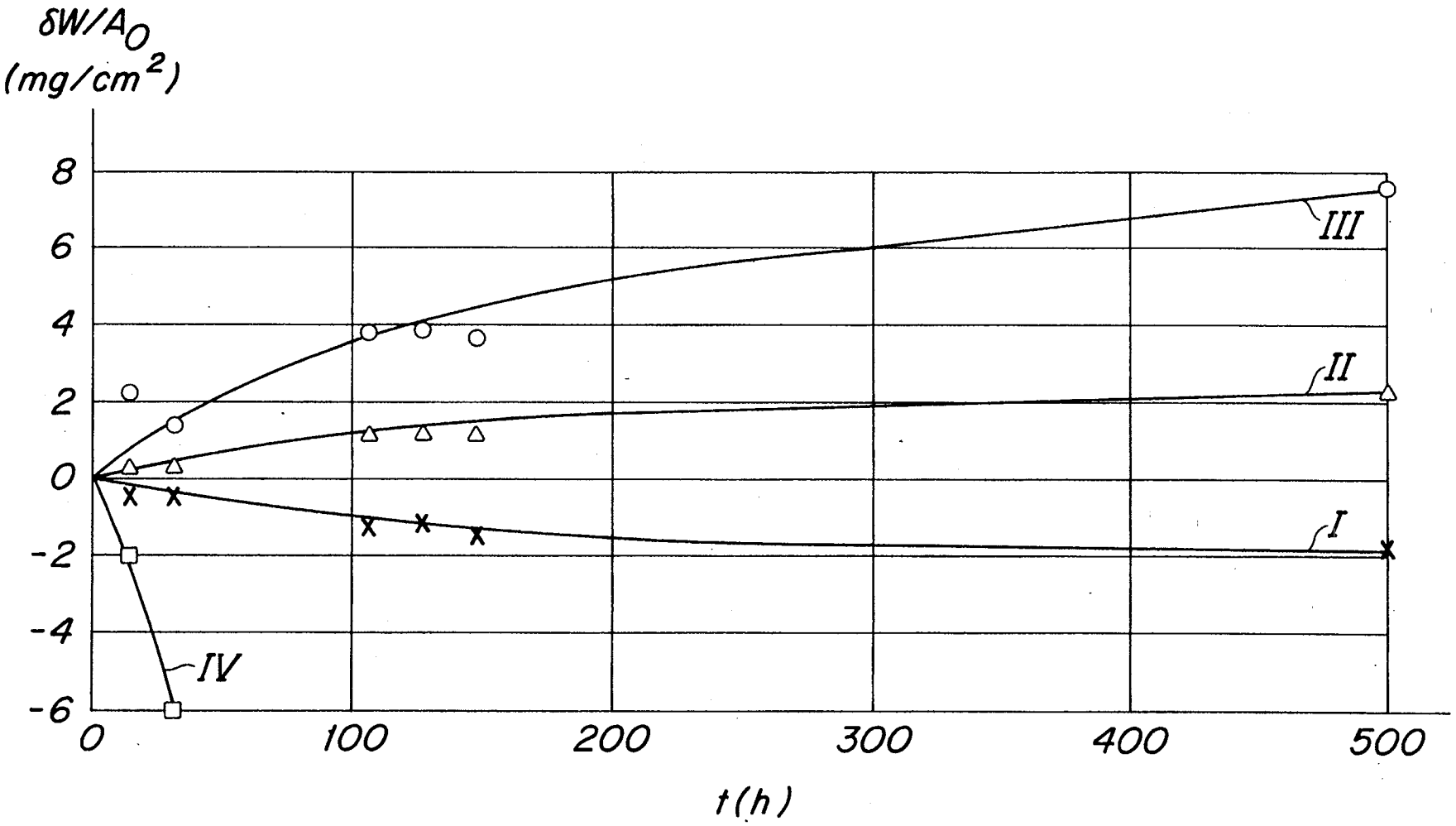
δW/A0
(mg/cm2)
8
6
4
2
0
-2
-4
-6
0
100
200
300
400
500
t(h)
I
II
III
IV

OXIDATION-RESISTANT AND CORROSION-RESISTANT ALLOY BASED ON DOPED IRON ALUMINIDE, AND USE OF SAID ALLOY

BACKGROUND OF THE INVENTION

1. Field of the Invention

Oxidation-resistant and corrosion-resistant alloys based on doped iron aluminide $Fe_3Al$ can be used in those thermally highly stressed parts of heat engines which are exposed to oxidizing and/or corrosive actions. In the latter, they should replace oxide-dispersion-hardened steels and nickel-base superalloys to an increasing extent.

2. Discussion of Background

The invention proceeds from an oxidation-resistant and corrosion-resistant alloy. Such an alloy, disclosed for instance in U.S. Pat. No. 5,158,744 A, contains 24 to 28 atomic % of aluminum, 0.1 to 2 atomic % of niobium, 0.1 to 10 atomic % of chromium, 0.1 to 1 atomic % of boron, 0.1 to 2 atomic % of silicon, the remainder being iron, as constituents. The known alloy is notable in the temperature range between 300° and 700° C. for a high oxidation resistance and corrosion resistance, and for an adequate heat stability. At room temperature, this alloy also has adequate ductility for many applications.

SUMMARY OF THE INVENTION

Accordingly, one object of the invention is to develop an alloy which is based on doped iron aluminide and which is notable for a high oxidation resistance and corrosion resistance even at temperatures above 700° C. The invention also relates to a suitable application of said alloy.

At high temperatures of, for example, 1200° C., the alloy according to the invention is notable for an oxidation resistance and corrosion resistance which generally far surpasses those of alloys according to the prior art. At the same time, the alloy according to the invention can be produced very economically by casting or by casting and rolling. A further advantage of the alloy according to the invention is that its constituents exclusively comprise metals which are comparatively inexpensive and are available independently of strategic and political influence. The alloy according to the invention has, moreover, a comparatively low density for certain applications in turbo-engines of only 6.5 g/cm$^3$, accompanied by adequate strength and ductility.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing.

The drawing shows a diagram in which the oxidation and corrosion properties of an alloy I according to the invention and alloys II, III and IV according to the prior art are shown as a function of time.

DESCRIPTION OF THE PREFERRED EMBODIMENTS

Referring now to the drawings, the sole figure shows a diagram in which the oxidation behavior and corrosion behavior of an alloy I according to the invention and three alloys II, III and IV according to the prior art is shown at 1200° C. as a function of time.

The alloys I, II, III and IV specified in the figure have the following composition: Alloy I (alloy according to a preferred embodiment of the invention):

| Constituent | % by weight | Atomic % |
|---|---|---|
| Aluminum | 16.38 | 28 |
| Niobium | 2.01 | 1 |
| Chromium | 5.64 | 5 |
| Silicon | 0.61 | 1 |
| Boron | 0.74 | 3.15 |
| Titanium | 1.38 | 1.33 |
| Iron | Remainder | Remainder |

Alloy II (oxidation-resistant and corrosion-resistant alloy having good properties at high temperatures and commercially obtainable under the trademark "Incoloy" and the designation MA 956): 20% by weight chromium, 4.5% by weight aluminum, 0.5% by weight titanium, 0.5% by weight yttrium oxide $Y_2O_3$, the remainder being iron.

Alloy III (alloy according to the prior art conforming to U.S. Pat. No. 5,158,744 A):

| Constituent | % by weight | Atomic % |
|---|---|---|
| Aluminum | 15.92 | 28 |
| Niobium | 1.96 | 1 |
| Chromium | 5.48 | 5 |
| Silicon | 0.56 | 1 |
| Boron | 0.11 | 0.5 |
| Iron | Remainder | Remainder |

Alloy IV ( oxidation-resistant and corrosion-resistant alloy having good properties at high temperatures and commercially obtainable under the trademark "Hastelloy" and the designation X): 22% by weight chromium, 18.5% by weight Fe, 1.5% by weight cobalt, 9% by weight molybdenum, 0.6% by weight tungsten, 0.5% by weight manganese, 0.5% by weight silicon, 0.1% by weight carbon, the remainder being nickel.

The alloys I and III, and an alloy which contains the constituents specified for the alloy I together with 300 ppm of C and 100 ppm of Zr were melted in an electric-arc furnace under argon as protective gas. The starting materials used were the individual elements with a degree of purity of more than 99%. The melt was cast to form a casting having a diameter of approximately 60 mm and a height of approximately 80 mm. The casting was remelted under vacuum and also cast under vacuum in the form of round rods having a diameter of approximately 12 mm and a length of approximately 150 mm or in the form of carrot-shaped ingots having a minimum diameter of approximately 12 mm, a maximum diameter of approximately 30 mm and a length of approximately 120 mm. Specimen bodies for tensile tests and platelets having a surface area of a few cm$^2$ and a thickness of approximately 1–2 mm were prepared from these and from the alloys II and IV.

The tensile tests were carried out as a function of temperature. For the alloy I according to the invention, these gave tensile-strength, elongation and elongation-after-fracture properties which were comparable at room temperature and at temperatures above approximately 700° C. with the corresponding properties of alloy III. Below a temperature of approximately 600° to 800° C., the alloys II and IV had better tensile-strength, elongation and elongation-after-fracture properties than the alloy I. The latter had, however, a higher elongation after fracture above the abovementioned temperature range than the two alloys II and IV.

The platelets produced from the castings of the alloys I, II, III and IV were heated to 1200° C. in air. The loss or increase in mass of each of the platelets due to oxidation and/or corrosion under these conditions was determined thermogravimetrically after certain time intervals, in particular after approximately, 15, 30, 108, 130, 145 and 500 hours. The loss in mass $-\delta W$ [mg] or the increase in mass $\delta W$ [mg] based on the size of the surface $A_O$ [$cm^2$] of each of the platelets is then a measure of the oxidation resistance and corrosion resistance of the alloys I to IV.

The sole figure shows the oxidation behavior and corrosion behavior, represented by the quotient $\delta W/A_O$, of the alloys I to IV as a function of time t [h] at an ambient temperature of 1200° C. From this it is evident that the alloy IV is severely oxidized and/or corroded at 1200° C. even after a few hours. The alloy III is already twice as severely oxidized and/or corroded as the alloy I made according to the invention after 500 hours, whereas the comparatively expensive alloy II, which is simply difficult to process because of its noncastability, has an oxidation resistance and/or a corrosion resistance at 1200° C. which is comparable with the alloy I.

A similar oxidation resistance and corrosion resistance is also to be observed in the case of an alloy which is made according to the invention and contains the same constituents as the alloy I but, in addition, also 300 ppm of carbon and 100 ppm of zirconium. This alloy is notable, in addition, for slightly increased strength and improved weldability.

The alloy according to the invention has good oxidation resistance and corrosion resistance if the aluminum content is not less than 24 and not more than 28 atomic %. If the aluminum content drops below 24 atomic %, the oxidation resistance and corrosion resistance of the alloy according to the invention deteriorate. If the aluminum content is higher than 28 atomic %, the alloy becomes increasingly brittle.

The oxidation resistance and corrosion resistance increase further by adding 0.1 to 10 atomic % of chromium to the alloy. Additions of more than 10 atomic % of Cr, however, generally impair the mechanical properties again.

The hardness and the strength of the alloy according to the invention are increased by adding 0.1 to 2 atomic % of niobium to the alloy. The ductility (elongation after break) passes through a maximum on adding 1 atomic % of niobium. In addition to, or instead of, niobium, tungsten and/or tantalum may also be added to the alloy in a proportion of 0.1 to 2 atomic %.

A proportion of 0.1 to 2 atomic % of silicon improves the castability of the alloy according to the invention and has a favorable effect on its oxidation resistance and corrosion resistance. In addition, silicon has a hardness-increasing effect.

The oxidation resistance and corrosion resistance of the alloy according to the invention are increased quite appreciably by adding 0.1 to 5 atomic % of boron and 0.01 to 2 atomic % of titanium to the alloy. This is primarily due to the fact that finely divided titanium diboride $TiB_2$ is then formed in the alloy. At high temperatures and under oxidizing and/or corrosive conditions, a protective layer, which predominantly contains aluminum oxide, is formed on the surface of the alloy according to the invention. The titanium diboride phase contributes a substantial stabilization to this protective layer since the titanium diboride phase anchors in the protective layer, for instance, in the form of needle-shaped crystallites from the alloy and, consequently, brings about a particularly good adhesion of the protective layer to the underlying alloy. The proportion of boron should not be more than 5 atomic % and that of titanium not more than 2 atomic % since otherwise too much titanium diboride is formed and the alloy becomes brittle. If the proportion of boron is below 0.1 atomic % and that of titanium below 0.01 atomic %, the oxidation resistance and corrosion resistance of the alloy according to the invention deteriorates quite considerably. A boron proportion of more than 1 atomic % but not more than 5 atomic % has proved very satisfactory.

A particularly good oxidation resistance and corrosion resistance accompanied simultaneously by good mechanical properties is achieved with an alloy according to the invention having the following alloying constituents:

| | | |
|---|---|---|
| Aluminum | 26 to 28 | atomic %, |
| Niobium | 0.5 to 1.5 | atomic %, |
| Chromium | 3 to 7 | atomic %, |
| Silicon | 0.5 to 1.5 | atomic %, |
| Boron | 2 to 4 | atomic %, |
| Titanium | 0.5 to 1.5 | atomic %, |

Iron, and, optionally, 100–500 ppm of carbon and/or 50 to 200 ppm of zirconium as the remainder.

The alloy according to the invention is preferably suitable for components which are exposed to oxidizing and corrosive actions at high temperatures and low mechanical stresses. Such components can be used with particular advantage for guiding a hot-gas flow and be designed, for instance, as internal lining of a combustion chamber, in particular for a gas turbine.

Obviously, numerous modifications and variations of the present invention are possible in light of the above teachings. It is therefore to be understood that, within the scope of the appended claims, the invention may be practiced otherwise than as specifically described herein.

What is claimed is:

1. An oxidation-resistant and corrosion-resistant alloy based on doped iron aluminide which, in addition to iron and aluminum, contains, as further alloying constituents at least niobium, chromium, silicon and boron and which contains the following alloying constituents in atomic percent:

24–28 aluminum,
0.1–2 niobium, tantalum and/or tungsten,
0.1–10 chromium,
0.1–2 silicon,
0.1–5 boron,
0.01–2 titanium, the remainder being iron.

2. An alloy as claimed in claim 1, which contains more than 1 atomic %, but not more than 5 atomic %, boron.

3. An alloy as claimed in claim 1, which contains the following alloying constituents:

26–28 aluminum,
0.5–1.5 niobium,
3–7 chromium,
0.5–1.5 silicon,

2–4 boron, 0.5–1.5 titanium, the remainder being iron.

4. An alloy as claimed in claim 1, which contains, in addition, the following constituents:

100–500 ppm of carbon and/or 50–200 ppm of zirconium.

5. A component exposed to oxidizing and/or corrosive actions, the component comprising an oxidation-resistant and corrosion-resistant alloy based on doped iron aluminide which in addition to iron and aluminum contains as further alloying constituents at least niobium, chromium, silicon and boron and which contains the following alloying constituents in atomic percent:

| | |
|---|---|
| 24–28 | aluminum, |
| 0.1–2 | niobium, tantalum and/or tungsten, |
| 0.1–10 | chromium, |
| 0.1–2 | silicon, |
| 0.1–5 | boron, |
| 0.1–2 | titanium, |

the remainder being iron.

6. The component as claimed in claim 5, wherein the component is used to guide a hot-gas flow.

7. The component as claimed in claim 6, wherein the component is the internal lining of a combustion chamber, in particular for a gas turbine.

* * * * *

UNITED STATES PATENT AND TRADEMARK OFFICE

CERTIFICATE OF CORRECTION

PATENT NO. : 5,422,070

DATED : June 6, 1995

INVENTOR(S) : Mohamed Y. NAZMY, et al.

It is certified that error appears in the above-indentified patent and that said Letters Patent is hereby corrected as shown below:

On the title page: Item

[73] Assignee: ABB Management AG, Baden, Switzerland

Signed and Sealed this

Fifth Day of March, 1996

Bruce Lehman

*Attest:*

BRUCE LEHMAN

*Attesting Officer*

*Commissioner of Patents and Trademarks*